US012571264B2

(12) United States Patent
Doster et al.

(10) Patent No.: US 12,571,264 B2
(45) Date of Patent: Mar. 10, 2026

(54) EARTH-BORING TOOLS AND METHODS OF MANUFACTURING AND USING SUCH EARTH-BORING TOOLS

(71) Applicant: Baker Hughes Oilfield Operations LLC, Houston, TX (US)

(72) Inventors: Michael L. Doster, Centerville, TX (US); Franklin Guillermo Valbuena, Conroe, TX (US); Armin Kueck, The Woodlands, TX (US); Eliah Everhard, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/643,660

(22) Filed: Apr. 23, 2024

(65) Prior Publication Data

US 2024/0410234 A1 Dec. 12, 2024

Related U.S. Application Data

(60) Provisional application No. 63/506,520, filed on Jun. 6, 2023.

(51) Int. Cl.
*E21B 10/62* (2006.01)

(52) U.S. Cl.
CPC ..... *E21B 10/62* (2013.01)

(58) Field of Classification Search
CPC ..... E21B 10/62; E21B 10/627; E21B 10/00
See application file for complete search history.

(56) References Cited

U.S. PATENT DOCUMENTS

| | | | | |
|---|---|---|---|---|
| 5,119,892 | A | 6/1992 | Hawke | |
| 2010/0193254 | A1 | 8/2010 | Lind et al. | |
| 2017/0101825 | A1* | 4/2017 | Olsen | E21B 10/42 |
| 2019/0128072 | A1* | 5/2019 | Griffo | E21B 10/42 |
| 2020/0398343 | A1* | 12/2020 | Voglewede | E21B 10/54 |

OTHER PUBLICATIONS

International Search Report for Application No. PCT/US2024/025871 dated Aug. 14, 2024, 3 pages.
International Written Opinion for Application No. PCT/US2024/025871 dated Aug. 14, 2024, 5 pages.

* cited by examiner

*Primary Examiner* — Caroline N Butcher
(74) *Attorney, Agent, or Firm* — TraskBritt

(57) ABSTRACT

An earth-boring tool includes a tool body including a central region the tool body comprising material having a first volumetric density. The earth-boring tool further includes inertia members, each inertia member disposed within the tool body radially outward of the central region, each inertia member comprising a material having a second volumetric density different than the first volumetric density.

19 Claims, 10 Drawing Sheets

EARTH-BORING TOOLS AND METHODS OF MANUFACTURING AND USING SUCH EARTH-BORING TOOLS

CROSS-REFERENCE TO RELATED APPLICATION

This application claims the benefit under 35 U.S.C. § 119(e) of U.S. Provisional Patent Application Ser. No. 63/506,520, filed Jun. 6, 2023, the disclosure of which is hereby incorporated herein in its entirety by this reference.

TECHNICAL FIELD

The disclosure relates generally to earth-boring tools, to methods of drilling wellbores in subterranean formations using such tools, and to methods of manufacturing such tools.

BACKGROUND

Wellbores are formed in subterranean formations for various purposes including, for example, extraction of oil and gas and extraction of geothermal heat from the subterranean formation. Wellbores may be formed in a subterranean formation using a drill bit such as, for example, an earth-boring rotary drill bit. Different types of earth-boring rotary drill include, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, for example through a downhole motor, steering assembly and other components, to an end of what is referred to in the art as a "drill string," which includes a series of elongated tubular segments connected end-to-end that extend into the wellbore from the surface of the formation. Often various tools and components, including downhole sensors, imaging devices, other earth-boring tools, and the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, as previously mentioned. The downhole motor may comprise, for example, a hydraulic Moineau-type motor having a shaft, to which the drill bit is coupled, which may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the inner surface of the wellbore.

BRIEF SUMMARY

In some embodiments of the disclosure, an earth-boring tool includes a tool body including a central region the tool body comprising material having a first volumetric density. The earth-boring tool further includes inertia members, each inertia member disposed within the tool body radially outward of the central region, each inertia member comprising a material having a second volumetric density different than the first volumetric density.

In additional embodiments of the disclosure, a method of manufacturing an earth-boring tool involves forming a central portion of a tool body from a first material having a first density. The method further includes forming a radially outward portion of the tool body including a second material having a second density different from the first density.

In yet further embodiments of the disclosure, a method of drilling a wellbore includes providing an earth-boring tool having a plurality of blades extending longitudinally and radially outward from a central region of the tool body. Each of the blades comprises a material having a first volumetric density. The earth-boring tool also includes a plurality of inertia members, each of which is disposed within a respective blade of the plurality of blades. Each of the inertia members comprises a material having a second volumetric density that is greater than the first volumetric density. The method further includes drilling the wellbore by rotating and advancing the earth-boring tool through a formation to form the wellbore.

BRIEF DESCRIPTION OF THE DRAWINGS

For a detailed understanding of the disclosure, reference should be made to the following detailed description, taken in conjunction with the accompanying drawings, in which like elements have generally been designated with like numerals, and wherein.

DETAILED DESCRIPTION

Figure 1:
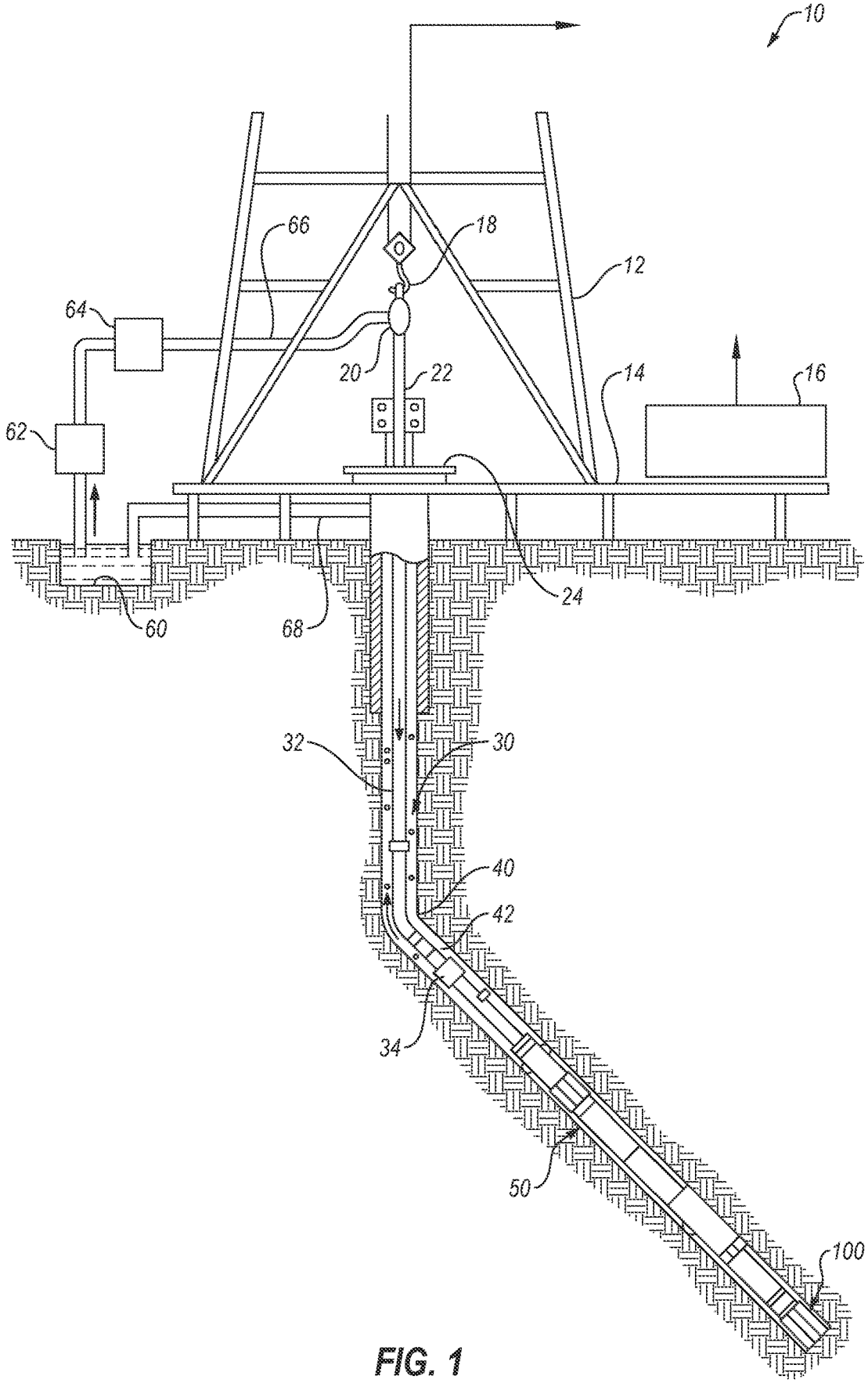
FIG. 1 is a schematic illustration of an example of a drilling system, which may include embodiments of earth-boring tools according to the disclosure.

The illustrations presented herein are not actual views of any drill bit, or any component thereof, but are merely idealized representations, which are employed to describe embodiments of the disclosure.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any drill bit when utilized in a conventional manner. Furthermore, these terms may refer to an orientation of elements of any drill bit as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the terms "distal" and "proximal" are used in reference to the surface (e.g., the drill bit, in contact with the subterranean formation, is at the distal end of the drilling system).

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "cutting element" means a super abrasive and super durable composite material. As a non-limiting embodiment, some cutting elements may be polycrystalline diamond compact (PDC) in composition.

As used herein, the term "longitudinal axis" refers to an axis that's orientation extends from the radial center of the bit on the attachment side, proximal to the surface, to the radial center of the distal side of the bit which is near the point of contact with the subterranean surface.

As used herein, the term "lateral axis" refers to an axis that is perpendicular to the longitudinal axis.

As used herein, the term "earth-boring tool" means any kind of earth-boring tool used for forming, enlarging, or for forming and enlarging a wellbore. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

When forming a wellbore, a drilling system rotates an earth-boring tool to loosen and remove material from the associated formation. During drilling, undesirable vibrations in the drill string may occur. These vibrations may result in damage to the earth-boring tool, and other components of the bottom-hole assembly and drill string. Vibrations can also reduce the efficiency of the drilling process.

Embodiments of the disclosure include earth-boring tools that include a tool body including one or more "inertia members" disposed in the tool body or components of the tool body. For example, the tool body may include a plurality of blades extending longitudinally and radially outward from a central region of the tool body. The blades are formed from and comprise a material having a first volumetric density. A plurality of "inertia members" are disposed respectively within the blades. The inertia members are formed from and comprise a material having a second volumetric density greater than the first volumetric density. By including the inertia members in the tool body or blades of the tool, the rotational inertia of the tool may be altered, such as to reduce vibrations and improve stability during use of the earth-boring tool to drill a wellbore. Furthermore, in some embodiments, the compositions, configurations, and locations of the inertia members may be selectively tailored to provide the earth-boring tool with a predetermined imbalance force during drilling, which may be advantageous in certain applications.

FIG. 1 depicts a non-limiting embodiment of a drilling system for drilling a wellbore in a subterranean formation. The drilling system includes an earth-boring tool. The earth-boring tool in the illustrated embodiment is a drill bit 100, which is advanced through a subterranean formation by being rotated from an assembly on the surface. The drilling system includes a drilling rig 10, which may include a derrick 12, a derrick floor 14, a draw works 16, a hook 18, a swivel 20, a Kelly joint 22, and a rotary table 24. A drill string 30, which may include drill pipe sections 32 and drill collar sections 34, extends downward from the drilling rig 10 into a wellbore 40. Various components of the distal end of the drill string 30, including the drill bit 100, are collectively referred to in the industry as a "bottom-hole assembly" (BHA) 50. The BHA 50 may include a number of measurement and analysis systems, such as a measurement-while-drilling (MWD) system or a logging-while-drilling (LWD) system. These systems may include various sensors for taking measurements.

During drilling operations, drilling fluid or "mud" may be circulated from a source 60 of drilling fluid through a fluid pump 62, through a desurger 64, and through a fluid supply line 66 into the swivel 20. The drilling fluid flows through the Kelly joint 22 into an axial central bore in the drill string 30. The fluid exits the drill string 30 via the drill bit 100. More specifically, the fluid exits the drill bit 100 through fluid ports or nozzles on the distal end 111 of the drill bit 100 near the point of contact with the subterranean formation. Upon exiting the drill bit 100, the drilling fluid flows toward the surface of the formation through an annular space 42 between the outer surface of the drill string 30 and the inner surface of the wellbore 40. Upon reaching the surface, the fluid is returned to the fluid source 60 through a fluid return line 68.

Figure 2:
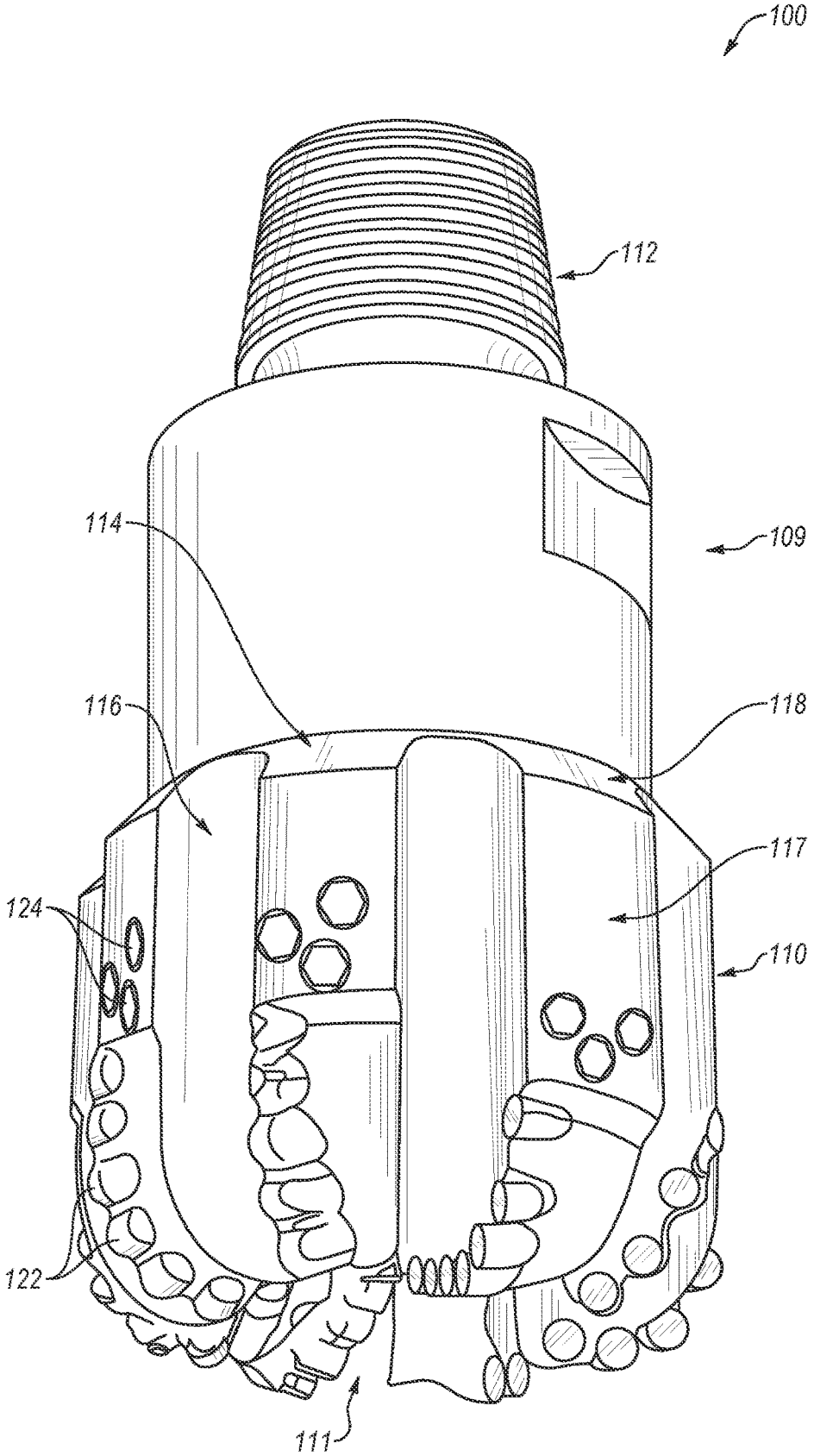
FIG. 2 is a perspective view of an embodiment of an earth-boring tool according to the disclosure.

FIG. 2 shows an embodiment of an earth-boring tool in accordance with the disclosure. The earth-boring tool of FIG. 2 is a fixed-cutter earth-boring rotary drill bit 100. The drill bit 100 includes a threaded pin 112 for coupling the drill bit 100 to the drill string 30. The drill bit comprises a bit body 110 having a plurality of blades 114, each of which extends longitudinally and radially outward from a central region of the bit body 110.

Each blade 114 of the plurality is formed of and comprises a material having a first volumetric density. In some embodiments, the bit body 110, including the central region and the blades 114, is formed of and comprises a steel alloy. The bit body 110 may comprise other materials in other embodiments, however, such as a particle-matrix composite material including hard particles (e.g., tungsten carbide particles) embedded or cemented within a metal alloy matrix material (e.g., a bronze alloy).

The blades 114 define channels 116 in between one another as they extend from the distal end 111 of the drill bit 100 toward the proximal end 109 of the drill bit 100. As is known in the industry, each blade 114 may comprise an inner cone region 130, a nose region 128 (at the distal most point of the drill bit 100), a shoulder region 126, and an outer gauge region 117. As the drill bit 100 creates the wellbore 40 in the subterranean formation, the gauge regions 117 of the blades define the largest diameter of the drill bit 100, and hence the diameter of the wellbore formed by the drill bit 100. Each gauge region 117 has a distal end 113 and a proximal end 115. The distal end 113 of each gauge region 117 being next to the shoulder region 126 of the blade 114. At the proximal end 115 of each gauge region 117, a proximal end surface 118 of the respective blade 114 extends radially inwardly toward the central region of the bit body 110. The proximal end surfaces 118 of the blades 114 are not in contact with the subterranean formation during drilling.

The gauge regions 117 of the blades 114 are in sliding contact with the formation during drilling, and may be provided with hard-facing material or wear-resistant inserts 124 to reduce wear and extend the operational life of the drill bit 100.

On the distal end 111 of the drill bit 100, cutting elements 122 are secured within cutting element pockets 132 formed at the rotationally-leading edge of each blade 114. The cutting elements 122 may be formed from a super-hard material, such as, a polycrystalline diamond compact (PDC), although embodiments of the disclosure are not limited to any particular type of cutting element.

Figure 3:
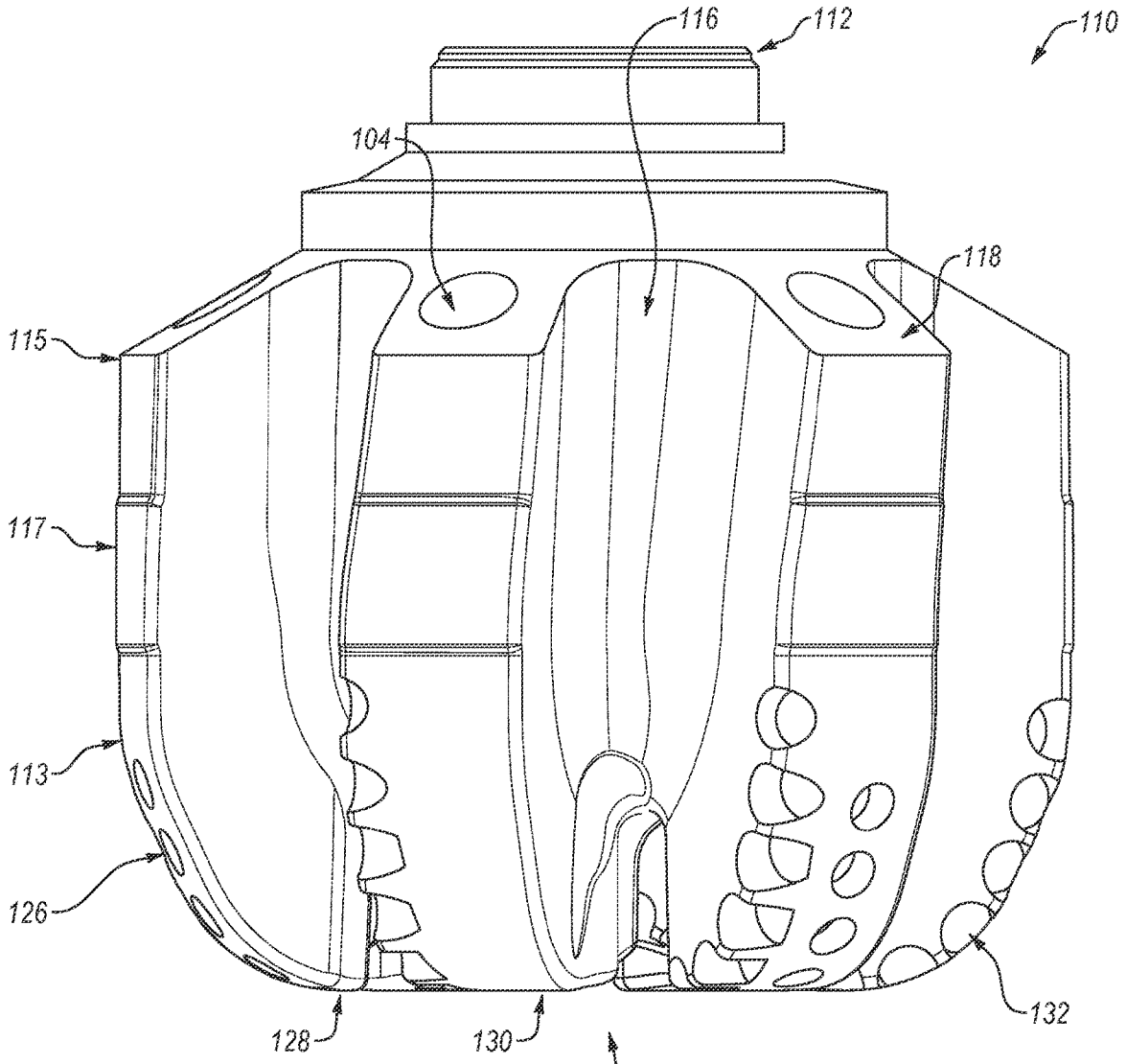
FIG. 3 is a side view of an embodiment of a tool body of an earth-boring tool according to the disclosure.

FIG. 3 is a side view of the bit body 110 of FIG. 2 prior to securing cutting elements in cutting element pockets 132, which have been formed in the blades 114 of the bit body 110 as described above. In accordance with embodiments of the disclosure, an inertia member 106 (FIG. 5) may be disposed within each blade 114. Each inertia member 106 comprises a material having a volumetric density greater than a volumetric density of the material of the bit body 110, including the central region and the blades 114. For example, the volumetric density of the inertia members 106 may be at least about 110% of the volumetric density of the bit body 110, at least about 125% of the volumetric density of the bit body 110, or even at least about 175% of the volumetric density of the bit body 110.

In additional embodiments, the inertia members 106 may have a volumetric density that is less than the remainder of the bit body 110. As examples, the volumetric density of the inertia member 106 may be about 90% or less of the volumetric density of the bit body 110, about 75% or less of the volumetric density of the bit body 110, or even about 25% or less of the volumetric density of the bit body 110.

Figure 9:
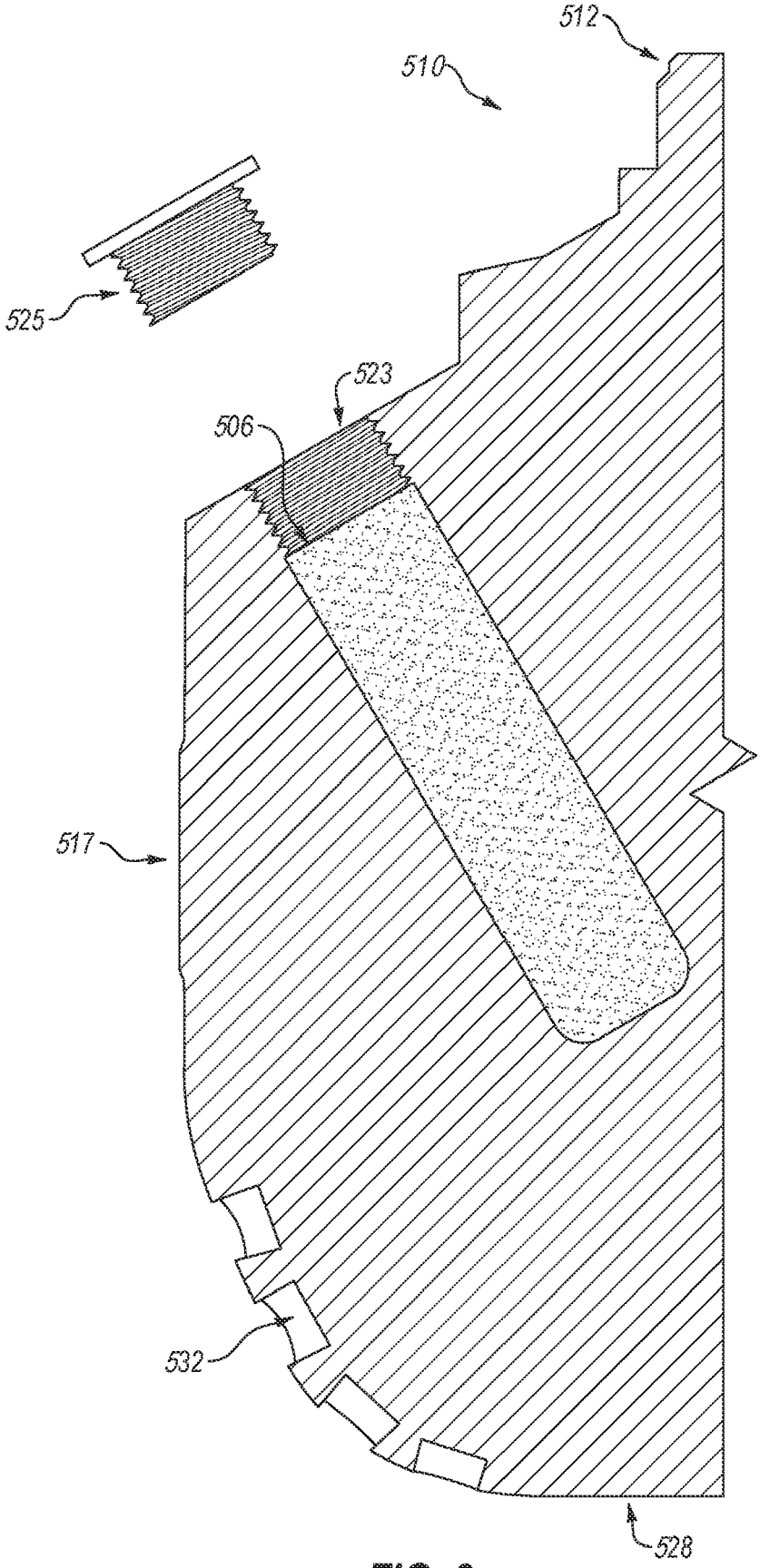
FIG. 9 is a partial longitudinal view of a tool body like that of FIGS. 5, 6 and 7 and illustrating an angled recess.

Recesses 104 may be formed that extend into the bit body 110 that are configured to receive the inertia members 106. In the embodiment illustrated in FIG. 3, the recesses 104 extend into the blades 114 from the proximal end surfaces 118 of the blades 114. The proximal end surfaces 118 of the blades may be perpendicular to a longitudinal axis of the bit body 110, or they may be oriented at an angle to the longitudinal axis of the bit body 110 as is shown in FIG. 9. In the embodiment of FIG. 3, one recess 104 is formed in each of the blades 114. In other embodiments, however, more than one recess 104 could be formed in any particular blade 114. Each blade 114 may be formed individually to have zero recesses, one recess, or several recesses in additional embodiments.

The inertia members 106 may comprise a relatively dense material, such as lead, tungsten, or an alloy thereof. The inertia members may comprise a material having a volumetric density, for example, ranging from about 2 g/cm$^3$ to about 25 g/cm$^3$ such as from about 5 g/cm$^3$ to about 15 g/cm$^3$, or about 8 g/cm$^3$. The relatively dense materials may provide the inertia members 106 enough weight to alter the rotational inertia of the drill bit 100.

Materials chosen for the inertia members are not limited to singular elements in the periodic table, but may be alloys, compounds, or composite materials. Furthermore, inertia members 106 comprising different materials and densities may be incorporated into the same bit body 110. For example, in some embodiments, the bit body 110 may comprise a material having a first volumetric density, at least one inertia member 106 may comprise a material having a second volumetric density greater than the first volumetric density, and at least one inertia member 106 may comprise a material having a third volumetric density that is also greater than the first volumetric density, but that is different than the second volumetric density. The material of the inertia member 106 having the third volumetric density may be different than the material of the inertia member 106 having the second volumetric density. In yet additional embodiments, the inertia members 106 may simply comprise voids filled with a liquid or a gas.

In some embodiments, the bit body 110 may comprise a metal alloy, such as steel. In such embodiments, the bit body 110 may be at least partially formed using conventional machining processes (e.g., turning, milling, and/or drilling) to form the bit body 110 from a blank volume of the metal alloy (e.g., a billet) or a forged blank that is close to a final volume and shape. When the bit body 110 comprises a machinable metal alloy, the recesses 104 may be machined in the bit body 110 using, for example, a drilling process.

If the bit body 110 comprises a material that is difficult to machine, or if the recesses 104 are to have a shape that is not easily machinable, the bit body 110 may be formed using, for example, a casting process or sintering process in a mold. Removable displacements having a size and shape corresponding to the recesses 104 may be positioned within the mold, and the bit body 110 may be formed by casting in the mold and around the removable displacements. The bit body 110 then may be removed from the mold, and the removable displacements removed from the bit body 110 to form the recesses 104.

Figure 4:
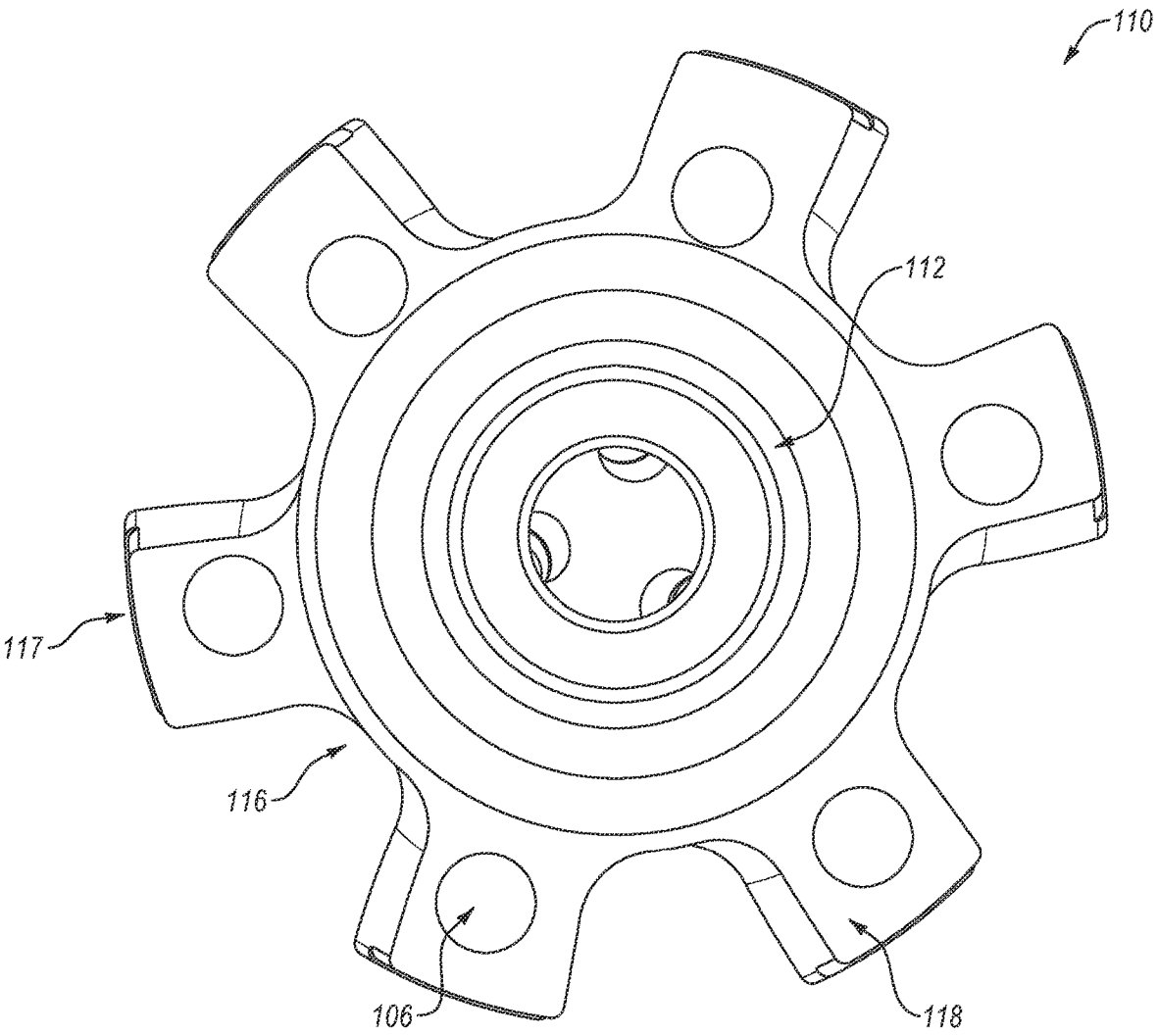
FIG. 4 is a top plan view of the tool body of FIG. 3.
Figure 5:
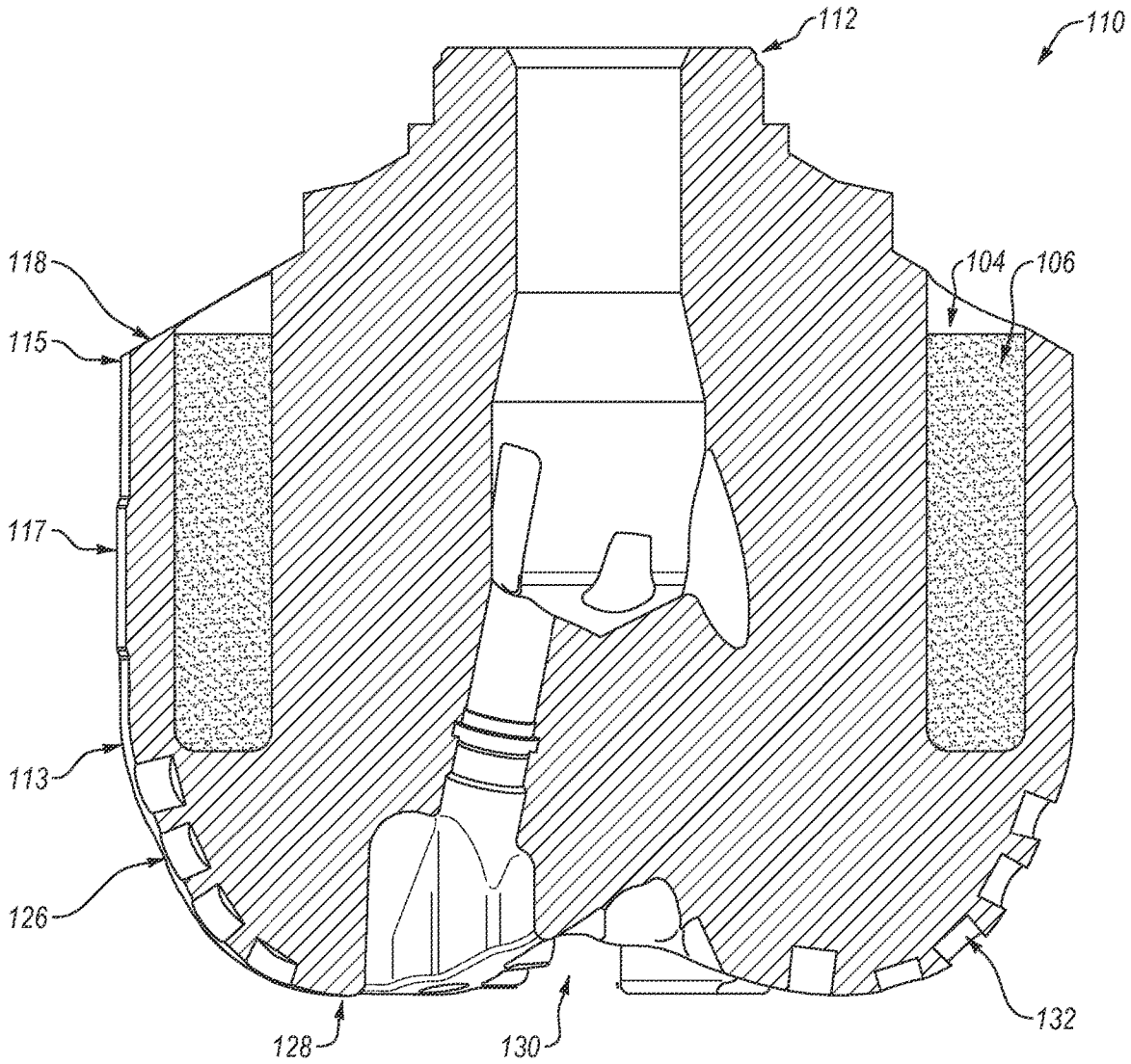
FIG. 5 is a longitudinal cross-sectional view of the tool body of FIGS. 3 & 4.

FIG. 4 is a top view of the bit body 110, and FIG. 5 is a longitudinal cross-section view of the bit body 110. As can be seen from FIGS. 4 and 5, the recesses 104 in which the inertia members 106 are disposed may be generally cylindrical. FIGS. 4 and 5 further illustrate the inertia members 106 disposed within the recesses 104. As illustrated in FIG. 5, each recess 104 may extend a distance into the respective blade in a direction at least substantially parallel to the longitudinal axis of the bit body 110. In some embodiments, the recesses 104 and inertia members 106 may extend distally beyond the gauge regions 117 of the blades 114 into the shoulder regions of the blades 114. Each inertia member 106 may be disposed entirely inside the respective blade 114.

In the embodiment illustrated in FIG. 5, the recesses 104 are cylindrical and have a longitudinal axis parallel to the longitudinal axis of the bit body 110. In other embodiments, the recesses 104 may have other shapes and orientations.

The inertia members 106 may have a size and shape complementary to the size and shape of the recesses 104, such that the inertia members 106 substantially fill the recesses 104, respectively. In other embodiments, the inertia members 106 may be smaller than the recesses 104. For example, one or more of the inertia members 106 may not extend the entire longitudinal length of the associated recess 104, such that an empty space remains in the associated recess 104 between a top of the one or more inertia members 106 and the proximal end surface 118 of the gauge region 117. The inertia members 106 may have a longitudinal length in a range from about 1 cm to about 10 cm, such as from about 1.42 cm to about 7.31 cm. The inertia members 106 and recesses 104 in the illustrated embodiment are generally cylindrical. However, the inertia members 106 and recesses 104 may also have any other shape, such as a square prism, a rectangular prism, a triangular prism, a rhombic prism, or a non-normal prism.

Figure 6:
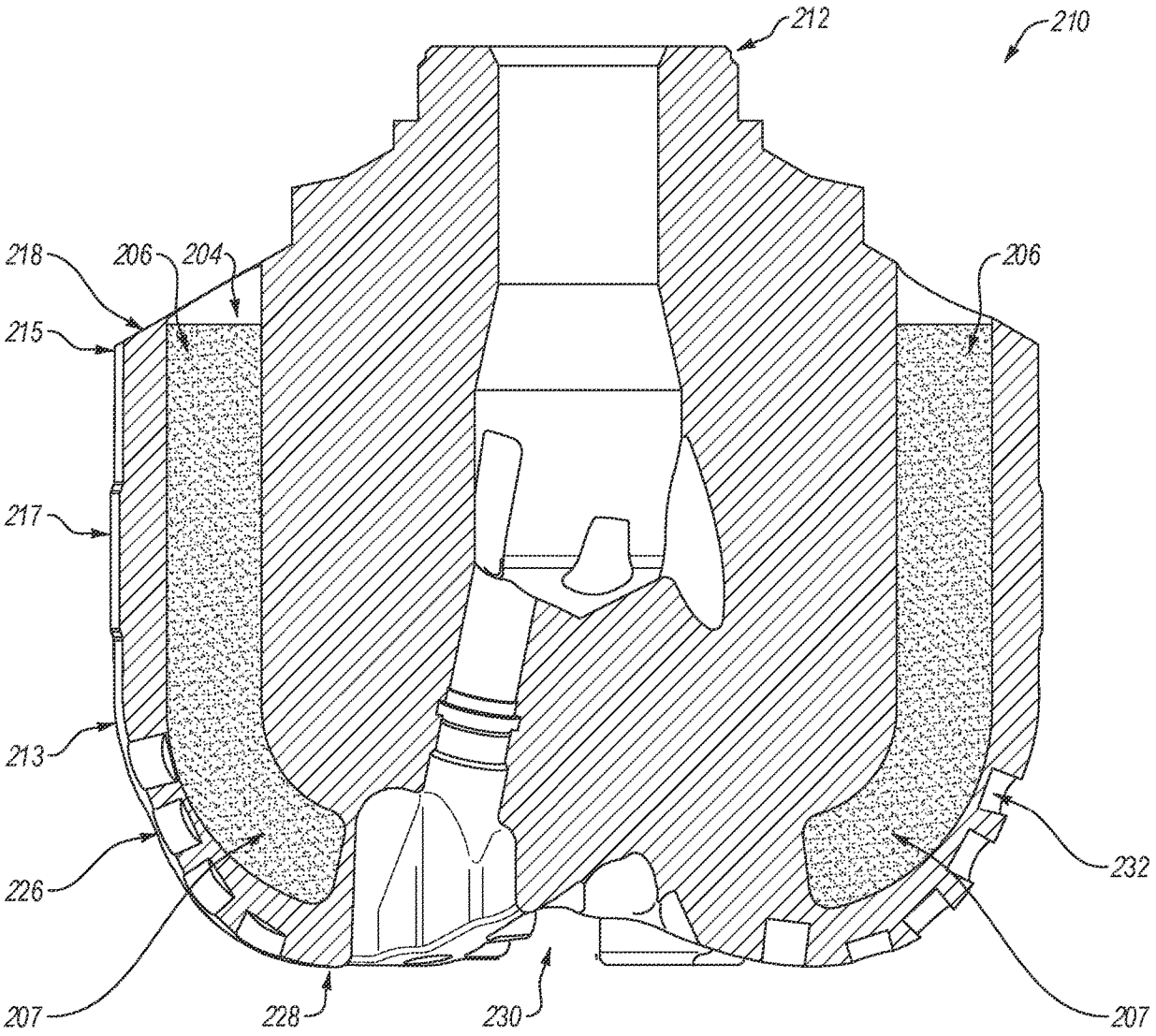
FIG. 6 is a longitudinal cross-sectional view like that of FIG. 5 showing another embodiment of a tool body of an earth-boring tool according to the disclosure.

FIG. 6 illustrates another embodiment of a bit body 210 substantially identical to the bit body 110 of FIGS. 3-5, and includes gauge regions 217, proximal end surfaces 218, and blades 214. In the embodiment of FIG. 6, each blade 214 includes a recess 204 that comprises a curved section 207 extending through the shoulder region of the blade 214 proximate the nose region 228 of the blade 214. The bit body 210 of FIG. 6 may be formed using a casting method as previously described. Similarly, the inertia members 206 of FIG. 6 may at least substantially fill the recesses 204 including the curved sections 207. In such embodiments in which the recesses 204 and complementary inertia members 206 have shapes that are amendable to separate fabrication and then insertion of the inertia members 206 into the recesses 204, the inertia members 206 may be formed by casting the inertia members 206 in place within the recesses 207.

In some embodiments, the inertia members 106, 206 may be removable so as to allow placement of inertia members of different densities within the drill bit 100, such as to adjust performance of the associated drill bit 100. For example, the dimensions of the inertia members 106, 206 may be very slightly reduced relative to the dimensions of the recesses 104, 204 to facilitate removal of the inertia members 106, 206 from the recesses 104, 204. In other embodiments, the inertia member 106, 206 may be formed from a flexible or conformable material, such as a liquid that may be removed or extracted from the associated 104, 204.

Figure 7:
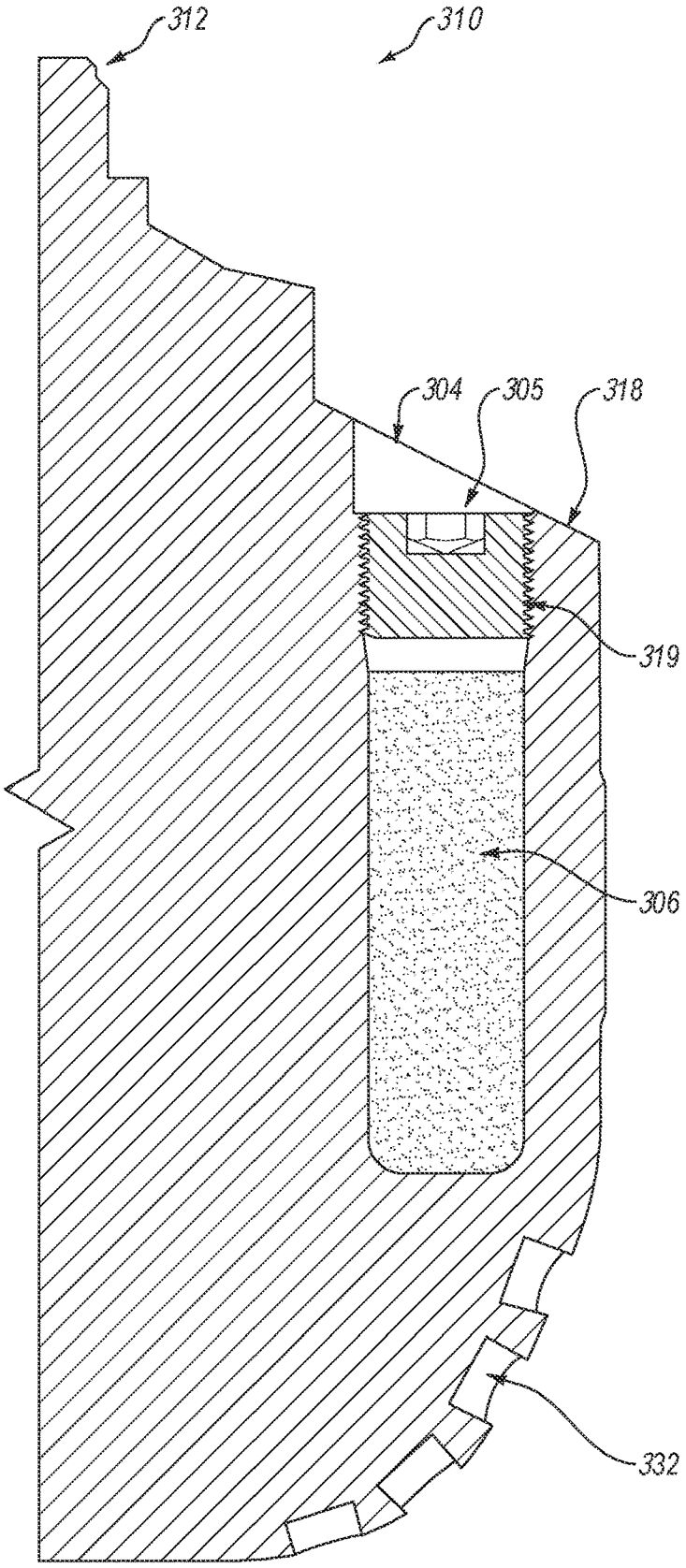
FIG. 7 is a partial longitudinal view of a tool body like that of FIGS. 5 and 6 and illustrating a cap securing an inertia member within a recess formed in a blade of the tool body.

FIG. 7 illustrates an embodiment of a drill bit configured to secure and remove an inertia member 306. In such embodiments, each inertia member 306 may be secured within the respective recess 304 using, for example, a cap or a plug 319, as shown in FIG. 7. The inner walls 305 of the blade within the recess 304 may be threaded at the upper end of the recess 304, and a cap or plug 319 having complementary threads may be threaded into the recess to secure the inertia member 306 therein. In additional embodiments, a braze alloy may be melted and cast in the recess 304 over the inertia member 306 to secure the inertia member 306 within the recess. In yet further embodiments, the plug or cap 319 may be secured through an interference fit (e.g., press-fit or shrink-fit) within the recess 304 over the inertia member 306 to secure the inertia member 306 within the recess 304.

The inertia of the bit may be modified by the placement and composition of the inertia members 106, 206, 306. When these inertia members 106, 206, 306 are placed further away from the center of rotation of the bit body 110, 210, 310, the inertia members 106, 206, 306 will increase the rotational inertia of the drill bit 100. The rotational inertia of a simple system, comprised of discrete mass points, may be calculated using the following equation:

$$I=\Sigma m_i r_i^2$$

In the equation above, the variable "$m_i$" is the mass of each mass point and "$r_i$" is the radial distance from the axis of rotation. The radius of the mass points has an exponential relationship with the rotational inertia of the system. Rotational inertia may thus be exponentially increased by placing mass further away from the rotational axis of the drill bit 100. Manipulating the density and radial position of the inertia members 106, 206, 306 facilitates the selective alteration of the rotational inertia of the drill bit 100. The rotational inertia of the drill bit 100 may be adjusted by changing the mass (e.g., changing the material and, hence, density) of the inertia members 106, 206, 306 or the volume of the inertia members 106, 206, 306. The mass of the system may be altered by changing the material of the inertia members 106, 206, 306, or the quantity of inertia members 106, 206, 306 present in their respective recesses 104, 204, 304.

Drill bits 100 as described herein may be designed using computer-aided design (CAD) software, and the designs then may be used in drilling simulation software used to model and simulate drilling and tool behavior in a particular formation. Such software can be used to predict occurrence of vibrations, and the design and composition of the inertia members 106, 206, 306 may be adjusted to reduce or eliminate anticipated vibrations in the drill bit 100 prior to fabrication and use thereof to form a wellbore in the actual formation that has been simulated.

In addition to using the inertia members 106, 206, 306 to selectively adjust a rotational inertia of the drill bit 100 to reduce or eliminate vibrations during drilling, the inertia members 106, 206, 306 may also be used to adjust an imbalance force acting on the drill bit 100 during drilling. For example, it is known that when all forces acting on a drill bit 100 during drilling are summed, a net lateral force acting on the drill bit 100 (the imbalance force) may be advantageous in certain instances or applications. Thus, it is known that the cutting element profile of a drill bit may be selectively designed and configured to result in an imbalance force acting on the drill bit during drilling.

Figure 8:
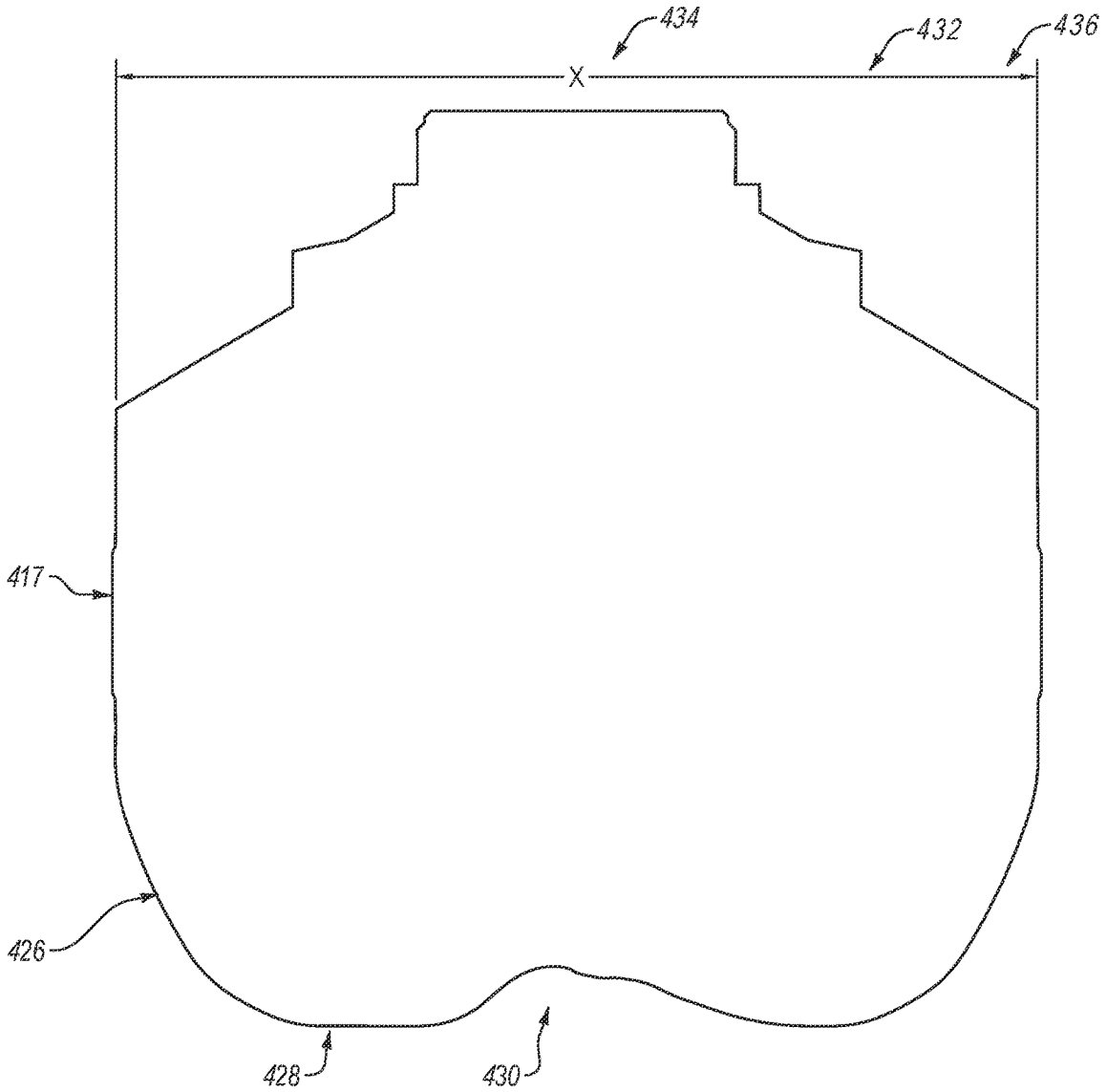
FIG. 8 is a longitudinal cross-sectional view like that of FIGS. 5 and 6 showing a density gradient of the bit body.

FIG. 8 shows a further embodiment of the bit body 410. The bit body 410 may have a density differential or gradient defined within the material of the bit body 410. For example, the density of the material forming the bit body 410 may vary along an X axis 432. For example, the density may be lower in quantity at the radial center 434 of the bit body 410 and larger at the radial edge 436 of the bit body 410 near the blade gauge regions 417. For example, the bit body 410 may be manufactured through an additive manufacturing process. Such an additive manufacturing process may involve the use of a material printer that deposits the material forming the bit body. The deposition rate and/or material composition may be adjusted by the material printer to establish a density gradient.

FIG. 9 shows an angled recess 523 oriented toward the longitudinal axis. This embodiment may facilitate easier removal of the inertia members 506 and/or insertion of the inertia members 506. During insertion, the angled recess 523 may be substantially perpendicular to the proximal end surface 518, thus making the angle of insertion easily viewed. The angled recess 523 may be at some other angle, other than perpendicular, relative to the proximal end surface 518 in additional embodiments. A threaded cap 525 may secure the inertia member 506 within the angled recess 523. The cap 525 may comprise a stop on one end which may seal the angled recess 523 when the cap 525 is substantially disposed within the angled recess 523.

The angled recess 523 may also facilitate changing a radial distance of the inertia member 506. For example, the inertia member 506 may have a length less than a total length of the angled recess 523, such that spacers having a density substantially the same as the material of the bit body 510 may be disposed into the angled recess 523 around the inertia member 506 to change the depth of the inertia member 506 within the angled recess 523, thus changing the radial distance between the inertia member 406 and the central axis of the bit body 510. In another embodiment, the inertia member 506 may be formed such that the inertia member 506 does not have a uniform density. Therefore, the inertia member 506 may have regions that are high density regions and other regions that are low density regions. The inertia member 506 may also have gradual density transitions between the high density regions and the low density regions, such that the inertia member 506 defines a density gradient gradually increasing or decreasing in density.

Figure 10:
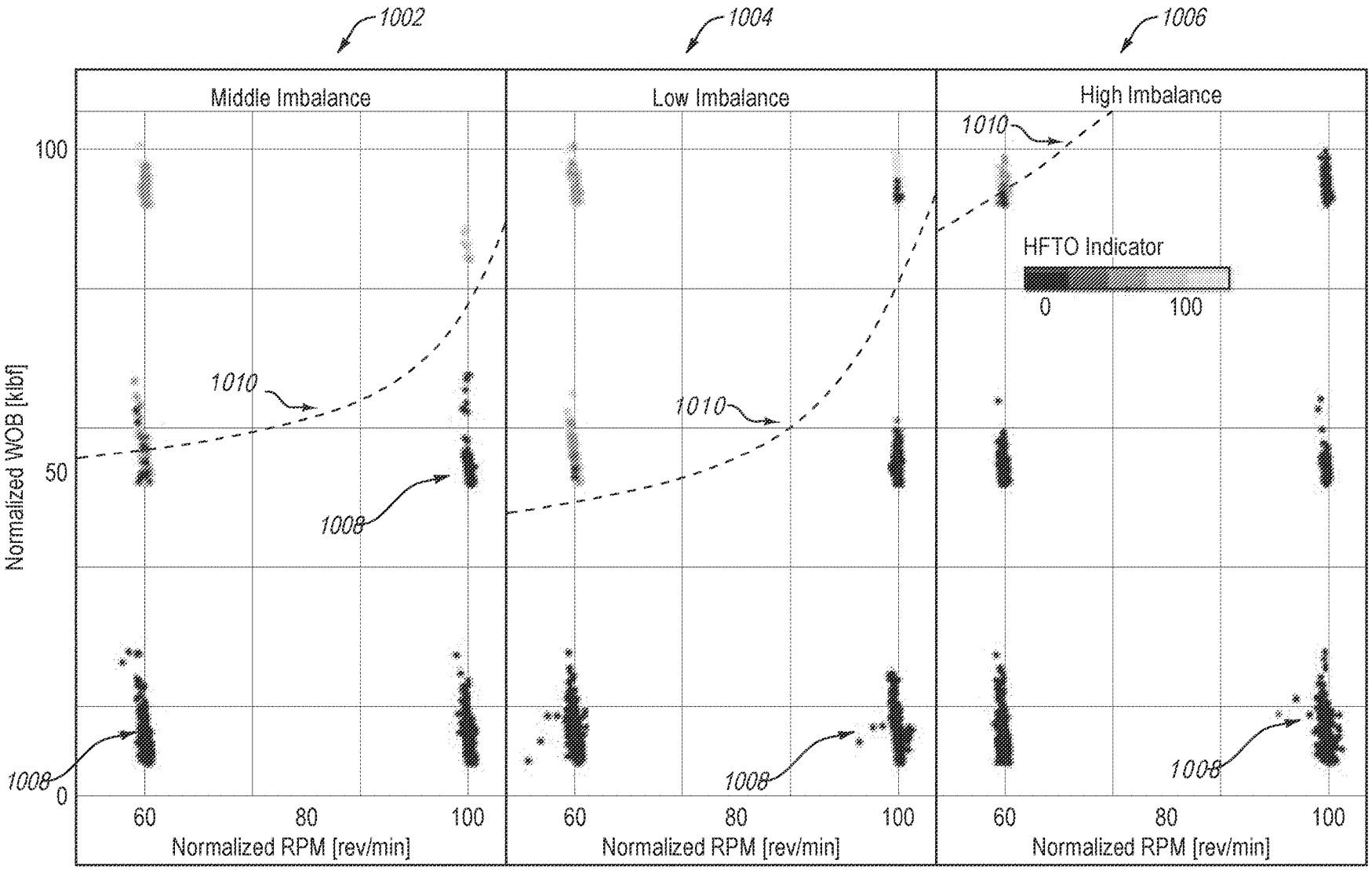
FIG. 10 depicts three graphs, each showing severity of vibrations at different drilling conditions of weight-on-bit (WOB) and rate-of-penetration (ROP) for earth-boring tools having different force imbalance characteristics.

FIG. 10 shows the results of drilling simulations of a drill bit with different magnitudes of imbalance forces. The graph 1002 on the left shows simulations for a drill bit having an average imbalance force, the graph 1004 in the middle shows simulations for a drill bit having a low imbalance force, and the graph 1006 on the right shows simulations for a drill bit having a high imbalance force. Clusters of dots 1008 in each of the graphs 1002, 1004, 1006 represent a few ranges of typical normalized operating parameters for WOB and rotational speed of the drill bit in units of revolutions-per-minute (RPM). The dots located below the dashed line 1010 in each graph 1002, 1004, 1006 are operating at values that result in higher drill string stability than those dots 1008 above the dashed line 1010 of each graph 1002, 1004, 1006. The clusters of dots 1008 above the dashed lines 1010 represent ranges of operating values where more drill string vibrations occurred in the simulations. As can be seen from the graphs 1002, 1004, 1006, the drill bit with the higher imbalance force (right graph 1006 of FIG. 10) has the greatest amount of operation values that are the least likely to result in drill string vibrations, and is thus considered to be a more stable drill bit.

The location and composition of the inertia members 106, 206, 306, 506 in drill bits 100 as described herein may affect the imbalance force of the drill bit 100 during drilling. Thus, the imbalance force of a drill bit 100 as described herein may be selectively tailored by selectively tailoring the size, location, and composition of the inertia members 106, 206, 306, 506. The imbalance force may be selectively adjusted using the inertia members 106, 206, 306, 506 to provide a drill bit 100 that is relatively more stable during anticipated drilling conditions.

The inertia members 106, 206, 306, 506 described herein are not active members of the drill bit 100. The inertia members 106, 206, 306, 506 are passive members that alter the inertia of the drill bit 100 by way of their selectively tailored density. The inertia members 106, 206, 306, 506 are not active components, such as fluid nozzles, wear inserts, or electrical components such as sensors.

The embodiments of the disclosure described herein and illustrated in the accompanying drawings do not limit the scope of the invention as defined by the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the disclosure.

What is claimed is:

1. An earth-boring tool, comprising:

a tool body including a central region the tool body comprising material having a first volumetric density;

one or more recesses defined in the tool body; and inertia members, each inertia member removably disposed within a recess of the one or more recesses defined in the tool body, the one or more recesses positioned radially outward of the central region, each inertia member comprising a material having a second volumetric density different than the first volumetric density.

2. The earth-boring tool of claim 1, further comprising a plurality of blades extending longitudinally and radially outward from the central region of the tool body.

3. The earth-boring tool of claim 2, wherein at least one inertia member is disposed within each blade of the plurality of blades.

4. The earth-boring tool of claim 1, wherein the inertia members are cylindrical.

5. The earth-boring tool of claim 4, further comprising a cylindrical recess defined in the tool body radially outward of the central region, wherein a single inertia member of the inertia members is disposed in the cylindrical recess.

6. The earth-boring tool of claim 5, wherein the tool body includes a gauge region having a distal end and a proximal end surface, the proximal end surface located and configured to not contact a formation surface during use of the earth-boring tool, and wherein the cylindrical recess extends into the tool body from the proximal end surface.

7. The earth-boring tool of claim 1, wherein the tool body and inertia members are configured such that the inertia members may be removed from the tool body without destruction of any portion of the tool body.

8. The earth-boring tool of claim 1, wherein the material having the first volumetric density comprises a particle-matrix composite material.

9. The earth-boring tool of claim 8, wherein the particle-matrix composite material comprises a cemented tungsten carbide material including particles of tungsten carbide cemented within a metal alloy matrix.

10. The earth-boring tool of claim 1, wherein the material having the second volumetric density comprises a material selected from a group consisting of lead, tungsten, or an alloy thereof.

11. The earth-boring tool of claim 1, further comprising cutting elements coupled to an outer portion of the tool body.

12. The earth-boring tool of claim 1, wherein the inertia members have a longitudinal length in a range from 1.42 cm to 7.31 cm.

13. A method of drilling a wellbore, comprising:

providing an earth-boring tool including:

a plurality of blades extending longitudinally and radially outward from a central region of a tool body, each blade of the plurality comprising material having a first volumetric density;

a plurality of recesses, each recess of the plurality of recesses defined within a respective blade of the plurality of blades; and a plurality of inertia members, each inertia member of the plurality disposed within a respective recess of the plurality of recesses, each inertia member of the plurality comprising a material having a second volumetric density greater than the first volumetric density;

drilling the wellbore by rotating and advancing the earth-boring tool through a formation to form the wellbore; and removing at least one inertia member of the plurality of inertia members from a respective blade of the plurality of blades.

14. The method of claim 13, wherein the providing of the earth-boring tool comprises inserting an inertia member of the plurality of inertia members into the respective blade of the plurality of blades.

15. The method of claim 13, further comprising inserting an additional inertia member comprising a material having a third volumetric density into the respective blade of the plurality of blades after removing the at least one inertia member of the plurality of inertia members from the respective blade of the plurality of blades, the third volumetric density being different than the first volumetric density and the second volumetric density.

16. A method of manufacturing an earth-boring tool, comprising:

forming a central portion of a tool body from a first material having a first density;

forming a radially outward portion of the tool body;

creating a density gradient between the first material of the central portion of the tool body and a third material of the radially outward portion of the tool body, the third material having a third density different from the first density and the second density;

forming a recess in the radially outward portion; and filling the recess in the radially outward portion of the tool body with a second material having a second density different from the first density.

17. The method of claim 16, wherein filling the recess with the second material comprises:

forming an inertia member from the second material, the inertia member having a size and shape complementary to the recess; and securing the inertia member in the recess.

18. The method of claim 16, further comprising:

forming the tool body through additive manufacturing.

19. The method of claim 16, further comprising selecting the second material to have a volumetric density of 8 $g/cm^3$ or more.

* * * * *